United States Patent [19]

Schottler

[11] 4,077,267

[45] Mar. 7, 1978

[54] FLUID TRANSDUCER

[76] Inventor: Henry Schottler, 346 SE. Verada Ave., Port St. Lucie, Fla. 33452

[21] Appl. No.: 704,059

[22] Filed: Jul. 9, 1976

Related U.S. Application Data

[63] Continuation-in-part of Ser. No. 430,332, Jan. 2, 1974, Pat. No. 3,971,259.

[51] Int. Cl.[2] ..... F16H 21/16

[52] U.S. Cl. ..... 74/25; 74/437; 92/58; 92/148; 417/273; 123/55 A

[58] Field of Search ..... 74/437; 123/55 A, 55 B, 123/44 E; 92/58, 148; 417/273

[56] References Cited

U.S. PATENT DOCUMENTS

| | | | |
|---|---|---|---|
| 314,221 | 3/1885 | Carnahan | 74/437 |
| 653,058 | 7/1900 | Beggs | 74/437 |
| 1,246,272 | 11/1917 | Hutchinson | 123/55 A |
| 1,790,198 | 1/1931 | Cizek | 123/55 R |
| 2,143,236 | 1/1939 | Birk | 74/437 |
| 2,700,285 | 1/1955 | Bellini | 74/437 |
| 3,077,870 | 2/1963 | Schmid | 123/44 E |
| 3,971,259 | 7/1976 | Schottler | 74/437 |

*Primary Examiner*—Samuel Scott
*Assistant Examiner*—Wesley S. Ratliff, Jr.
*Attorney, Agent, or Firm*—Melvin F. Jager

[57] ABSTRACT

A fluid transducer including a reciprocatory piston member and a drive mechanism for converting reciprocation of the piston member into rotation of a rotary member coupled to the mechanism, or vice versa. The drive mechanism includes a first elliptical member centrally mounted within said transducer and a second elliptical member rotatably mounted in engagement with said first member and arranged for reciprocation with said piston member. As said piston member reciprocates said second member rotates with respect to said first member to transmit motion between said piston and said rotary member coupled to the drive mechanism.

13 Claims, 15 Drawing Figures

FIG. 7
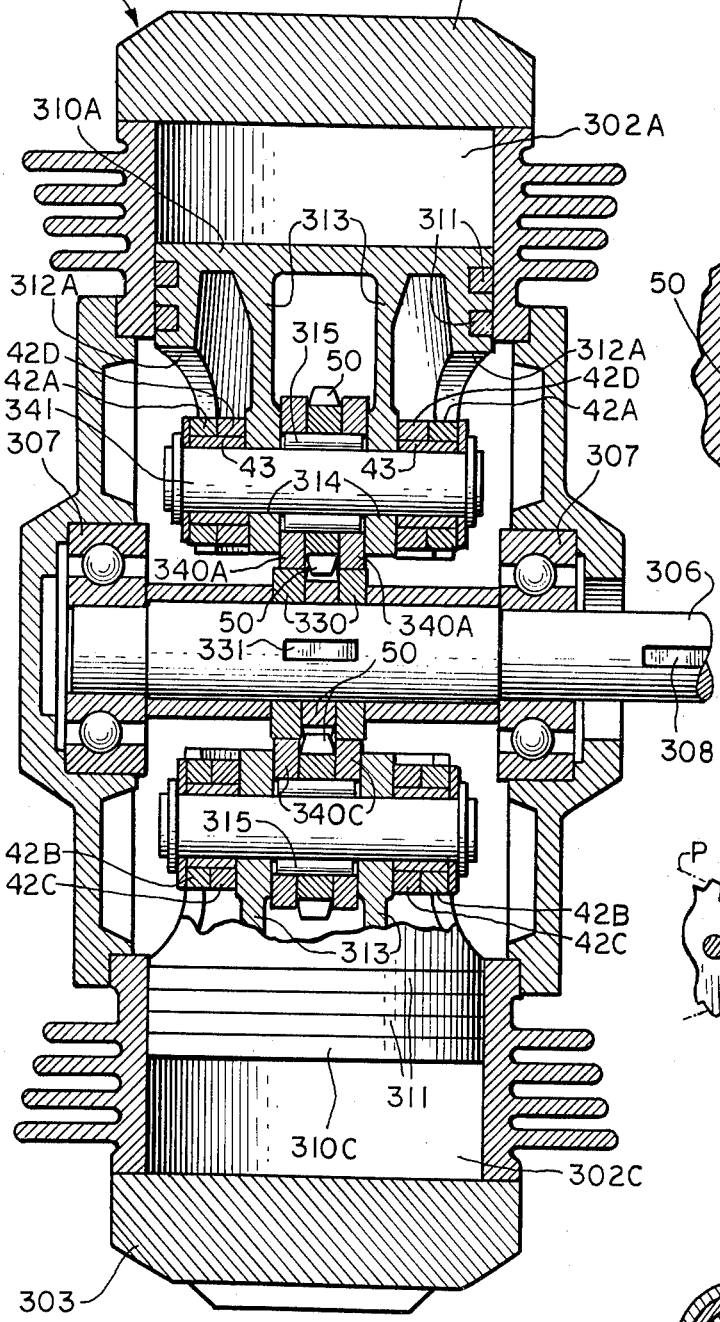
FIG. 8
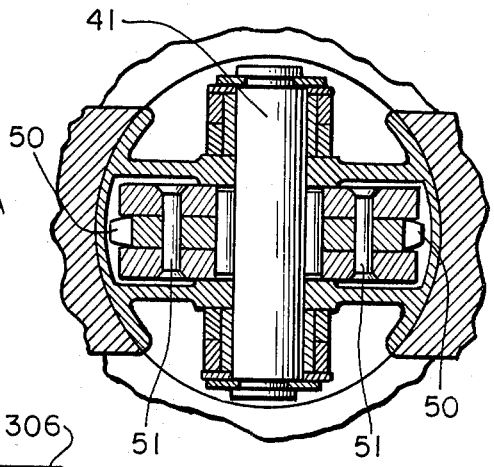
FIG. 10
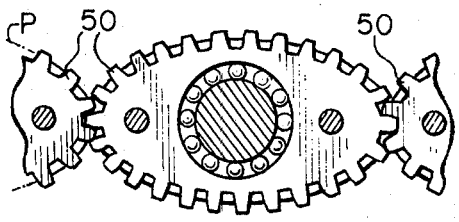
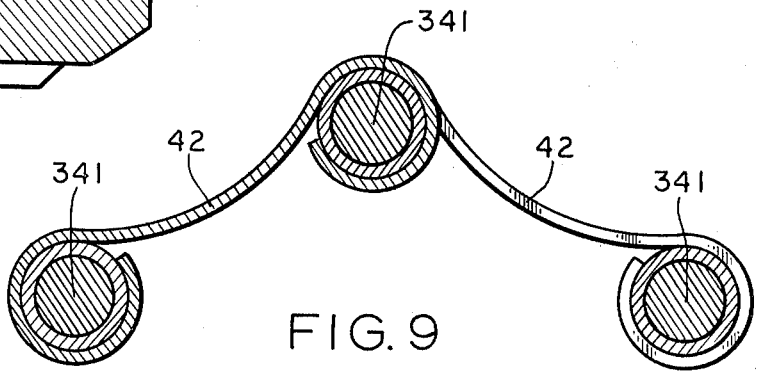
FIG. 9

FIG. 11
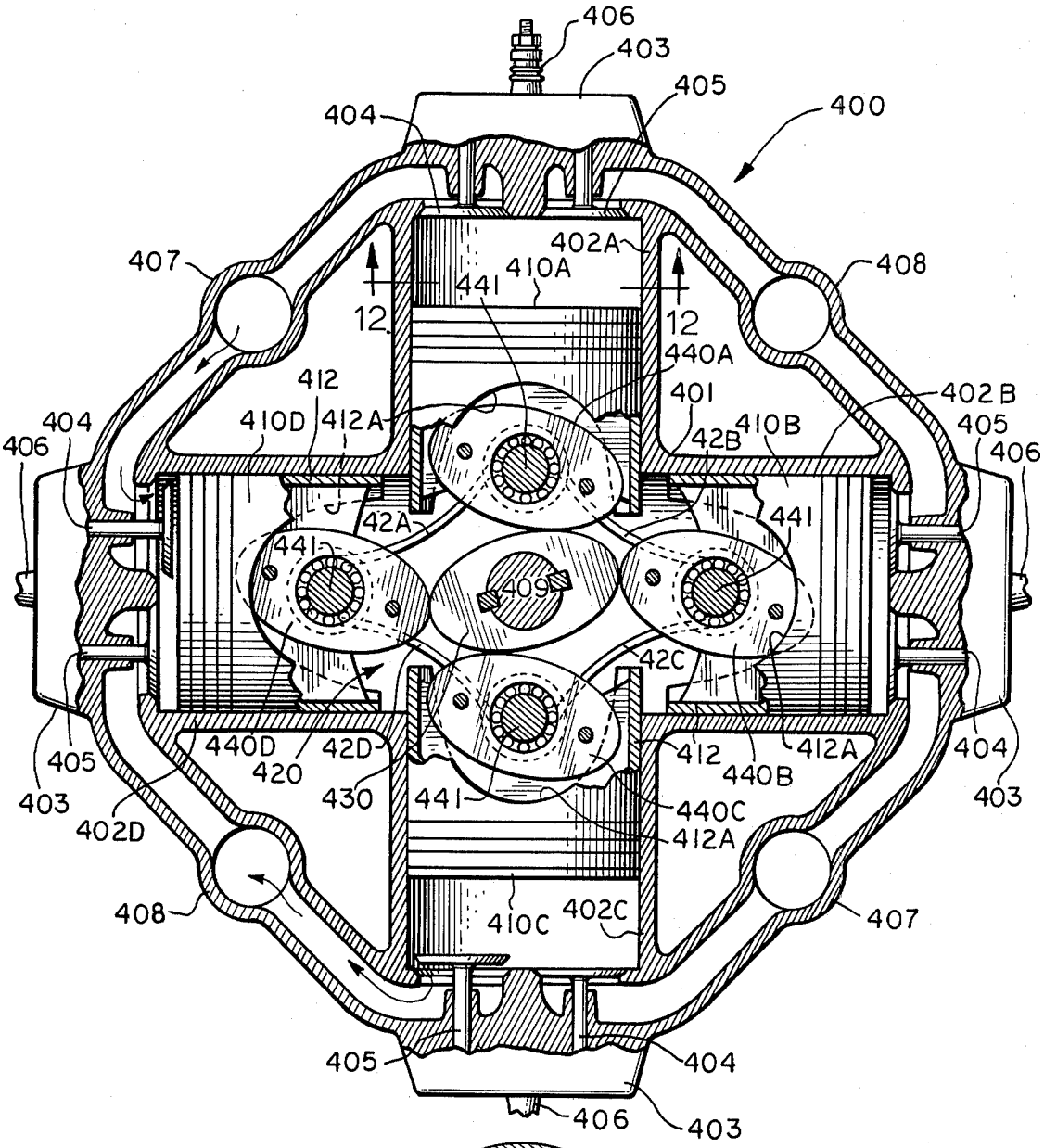
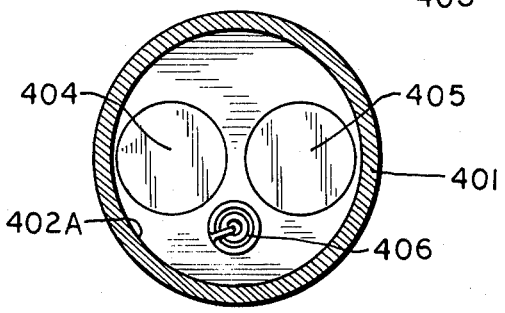
FIG. 12

FLUID TRANSDUCER

GENERAL BACKGROUND AND DESCRIPTION

This is a continuation-in-part of pending application Ser. No. 430,332 filed Jan. 2, 1974 now U.S. Pat. No. 3,971,259.

This invention relates generally to fluid transducers, and more particularly relates to fluid transducers incorporating an elliptical drive mechanism for converting rotary motion into reciprocatory motion, or vice versa. In one form of the invention the transducer can be utilized as an engine or motor to convert fluid-induced reciprocatory motion into rotary motion. In other forms of the invention, the transducer may be utilized as a pump or compressor to convert the rotary motion of a shaft into reciprocatory motion of the piston.

There is a constant need in the fluid transducer field for an improved drive mechanism for transmitting energy to or receiving energy from a fluid through the efficient conversion of reciprocatory motion into rotary motion, or vice versa. In standard reciprocating piston mechanism, for example, there are substantial motion and friction losses due to the need for crank shafts, connecting rods and the like.

Many prior attempts have been made to improve upon the standard crank shaft and connecting rod mechanism. For example, cam drive mechanisms have been designed which replace the standard crank shaft and connecting rods with a rotary drive cam and reciprocatory cam roller followers. Many of these prior cam drive mechanisms, however, still produce substantial motion and friction losses when transmitting motion between a reciprocating piston and a rotary shaft.

A substantial amount of these losses in prior mechanisms is due to the design of the drive cam and cam followers. Generally, the prior drive mechanisms use specifically designed drive cams and circular roller cam followers, or other arrangements, which cause relative acceleration and deceleration and sliding friction to occur between the engaged parts. Such action produces motion and friction losses which decrease the operating efficiency of the drive mechanism.

It is therefore the principal object of this invention to provide an improved transducer drive mechanism which substantially reduces the foregoing motion and friction losses in converting reciprocating motion into rotary motion, or vice versa. According to this invention, the need for standard crank shafts and connecting rods is eliminated, and the problems experienced with earlier cam drive mechanisms are overcome, by providing a novel elliptical drive mechanism wherein the engaged rotary and reciprocatory components of the mechanism are elliptical in configuration. The engagement between the elliptical members in accordance with this invention is rolling contact which is substantially free of sliding friction and motion losses. The design of this invention produces such rolling contact by moving each of the engaged elliptical members with a constant angular velocity which precludes relative acceleration or deceleration of the engaged members.

Briefly described, one embodiment of the elliptical drive mechanism is accordance with this invention includes an elliptical member connected for rotation with a rotary member, such as a rotary input or output shaft. A second elliptical member is rotatably mounted in the transducer so that it is free to rotate, and to simultaneously reciprocate with a transducer piston member.

The elliptical members are arranged to engage each other and rotate in unison as the piston reciprocates with respect to the rotary member.

In a second embodiment a rotor with a radial cylinder therein is positioned within a housing. A rotary shaft, coupled to the rotor, drives or is driven by the rotor. One elliptical member is stationary with respect to the housing in this embodiment. A second elliptical member is rotatably mounted as in the first embodiment so that it can rotate and reciprocate with a transducer piston member. The elliptical members engage each other so that the second elliptical member rolls around the first as the piston reciprocates with respect to the stationary elliptical member.

In compressor or pump or the like, the rotation of the shaft and the connected elliptical member of the first embodiment or the rotor of the second embodiment causes rotation of the other engaged elliptical member in a manner which induces reciprocation of the connected piston. The opposite result occurs when the transducer is adapted for use as an engine. In such an arrangement, the reciprocation of the piston member causes the connected elliptical member to reciprocate and rotate, to thereby rotate the other engage elliptical member in the first embodiment or the rotor in the second embodiment. Means are also provided in the transducer to maintain the elliptical members in driving engagement and to synchronize the relative position and/or rotation of the engaged elliptical members throughout these operations.

EXEMPLARY EMBODIMENTS

Additional objects and features of this invention will become apparent from the following description of several embodiments thereof, taken in conjunction with the accompanying drawings, wherein:

FIG. 7 is a cross-sectional elevational view of the compressor taken along the line 7—7 in FIG. 6;

FIG. 8 is a removed and enlarged sectional view of the compressor taken along line 8—8 in FIG. 6;

FIG. 9 is an enlarged cross-sectional view of a linkage mechanism embodied in the compressor shown in FIGS. 6–8 for retaining the elliptical members in rolling engagement during the operation of the compressor;

FIG. 10 is a removed plan view of a gearing mechanism embodied in the compressor shown in FIGS. 6–9 to synchronize the rotational movement of the elliptical members;

FIG. 11 is a cross-sectional elevational view of an opposed piston internal combustion engine embodying the elliptical drive mechanism of the present invention;

FIG. 12 is a cross-sectional view of a piston cylinder taken along lines 12—12 in FIG. 11;

Figure 1:
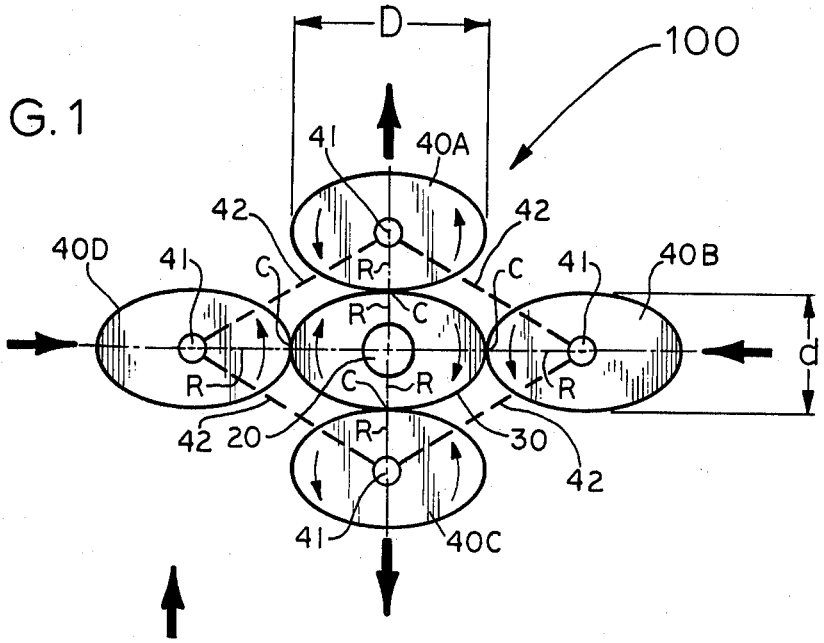
FIG. 1 is a schematic illustration of the elliptical drive mechanism in accordance with this invention at the beginning of an operating stroke.
Figure 2:
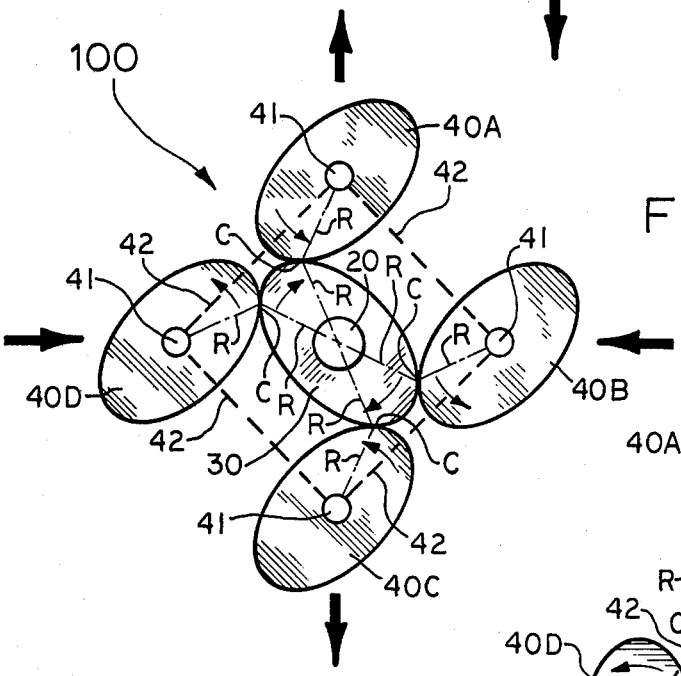
FIG. 2 is a schematic illustration of the elliptical drive mechanism of this invention shown in an intermediate stroke position.
Figure 3:
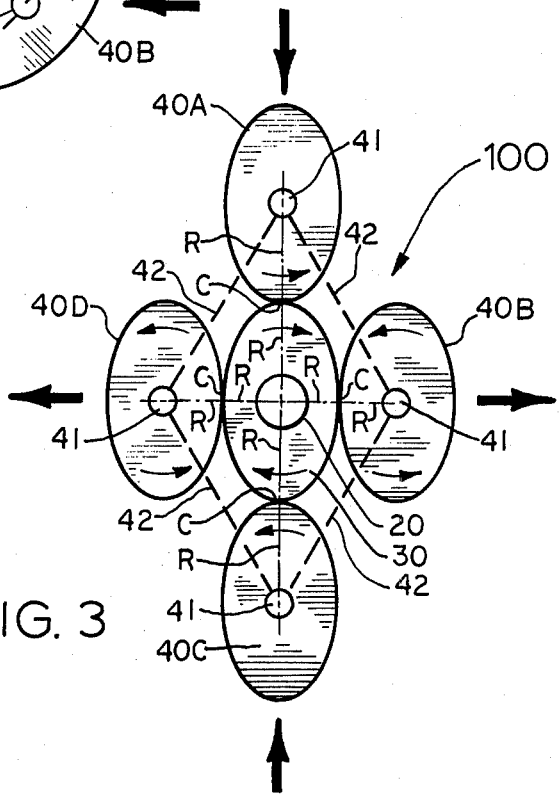
FIG. 3 is a schematic illustration of the elliptical drive mechanism of the present invention shown at the end of an operating stroke.

FIGS. 1-3 of the drawings illustrate the general principles embodied in the drive mechanism in accordance with one embodiment of the present invention. The drive mechanism generally designated by the reference numeral 100, includes a centrally disposed rotary member, such as an input or output shaft 20. A central elliptical member 30 is joined for rotation with the central shaft 20. In an engine, member 30 will be a driving member, and in a pump or compressor, the member 30 will be the driven member. The shaft 20 is connected to the member 30 at the elliptical center-point of the member.

The drive mechanism also includes a plurality of reciprocatory elliptical members 40A-D which are uniformly arranged around the periphery of the rotary member 30. Each of the members 40A-D are mounted in the drive mechanism 100 for rotation about centrally located wrist pins 41. In accordance with this invention, the wrist pins 41 are connected to reciprocatory pistons, or are otherwise guided, so that the pins 41 and the associated members 40A-D simultaneously rotate about their wrist pin 41, during the operation of the drive mechanism 100. A second embodiment comprising a rotary fluid transducer depicted in FIGS. 13-16 operates in accordance with similar principles as the first embodiment except that the central elliptical member here shown as 530 or 630 is stationary and the cylinder block or rotor 503 or 603 as it is more accurately called, rotates within a stationary housing 501 or 601. The rotor is coupled to an input or output shaft 506 or 606. As with the first embodiment this drive mechanism includes a plurality of reciprocatory elliptical members 40A-D shown in FIGS. 1-3 which are uniformly arranged around the periphery of the central elliptical member 30. The difference in the second embodiment is that the central member 30 is stationary and each of the members 40A-D rotate about the central member 30 in centrally located wrist pins 41. The wrist pins 41 are connected to reciprocatory pistons or are otherwise guided, as with the first embodiment, so that the pins 41 and the associated members 40A-D reciprocate with respect to the central member 30, and the members 40A-D simultaneously rotate about their wrist pins 41, during the operation of the drive mechanism.

To obtain static and dynamic balance, the drive mechanism of the present invention is designed to be incorporated within a transducer having two pairs of opposed piston members, with the members 40A and 40C, as well as the members 40B and 40D, diametrically opposed about the central elliptical member 30.

Means are also provided in the drive mechanism 100 of both the first and second embodiments to retain the reciprocatory elliptical members 40A-D in engagement with the periphery of the central elliptical member, and to synchronize the motion of the members, during the operation of the mechanism. In the illustrated embodiment, positive engagement between the elliptical members 30 and 40A-D is accomplished by connecting the adjacent wrist pins 41 with links 42 extended between adjacent wrist pins 41. As seen in FIGS. 1—3, the links 42 are pivotally connected to the wrist pins 41, and permit the associated members 40A-D to rotate about the wrist pins 41 and simultaneously reciprocate with respect to the center of the central elliptical member 30 during the operation of the drive mechanism 100. Each of the links 42 has the same length so that the elliptical centerpoints of the members 40A—D and the wrist pins 41 are spaced by a selected constant distance during the operation of the mechanism 100. As shown in FIG. 9, the links 42 in the illustrated embodiment comprise straps formed from spring steel or the like which is designed to apply an inward biasing force to wrist pins 41. Such an arrangement causes the links 42 to apply an inwardly directed preload force to the members 40A-D that assists in maintaining the members 40A-D engaged with the members 30.

The drive mechanism 100 includes additional means to assure that the relative rotation of the elliptical members 30 and 40A-D is synchronized in the first embodiment or to assure the synchronization of the reciprocatory elliptical members 40A-D in the second embodiment where the central elliptical member 30 is stationary. As shown in FIG. 10, the synchronization means in the illustrated embodiment comprises elliptical rolling contact gearing 50 provided on each of the elliptical members 30 and 40A-D. The gearing 50 is arranged so that the rolling engagement of the members 30 and 40A-D simultaneously causes the gearing on the member 30 to mesh with the gearing on the members 40A-D. The pitch line of the teeth provided on the elliptical gearing 50 is coincident with the elliptical surface of the associated elliptical member 30 or 40A-D to assure smooth and quiet meshing of the gearing 50.

In accordance with this invention, each of the elliptical members, such as 30 and 40A-D, incorporated in the drive mechanism has an elliptical configuration made in accordance with the following standard formula:

$$\frac{X^2}{a^2} + \frac{Y^2}{b^2} = 1$$

wherein $2a$ equals the major elliptical diameter; $2b$ equals the minor elliptical diameter; and X and Y are the abbsisa and ordinate, respectively of any point on the elliptical surface.

The major diameters ($2a$) of the elliptical members 30 and 40A-D is indicated in FIG. 1 to 3 as 'D'; and the minor diameters ($2b$) as 'd'. The contact points between the member 30 and the members 40A-D are indicated by the points 'C'. The distance from the rotational centerpoint of each of the elliptical members 30 and 40A-D to the contact points C is the contact radius indicated as 'R'.

To obtain the maximum features and advantages of the present invention, each of the engaging elliptical members 30 and 40A-D have identical major and minor diameters D and $d$, and are therefore identical in configuration. In addition, the reciprocatory members 40A-D are arranged with respect to the central member 30 so that the contact points C will be coincident with the aligned major and minor diameters D and d during rotation. Thus, as seen in FIG. 1, during one stage of operation the contact points C between the member 30 and the opposed members 40A and C will be coincident with the aligned minor diameters d of the members 30, 40A and 40C. Likewise, the contact points C between the member 30 and the opposed members 40B and 40D will be coincident with the aligned major diameters D of the members 30, 40B and 40D.

In the position shown in FIG. 1, the contact radius R for the members 40A and 40C is equal to one-half of the minor diameter d, and the contact radius R for the members 40B and 40D is equal to one-half the major diameter. This position represents the limits for the inward strokes for the pistons associated with the members 40A and 40C, and the limits of the outward strokes for the pistons associated with the members 40B and 40D. As seen in FIG. 3, this arrangement is reversed upon rotation of the members 30 and 40A–D by ninety degrees and the completion of a full outward stroke for the pistons associated with the members 40A and 40C, and a full inward stroke for the pistons associated with the members 40B and 40D.

As seen from FIGS. 1–3, the contact radius C for each of the elliptical members 30 and 40A–D varies from the minor diameter *d* (FIG. 1 for 30, 40A and 40C) to the major diameter D (FIG. 3 for 30, 40A and 40C) during the operation of the drive mechanism 100. As shown by FIG. 2, the contact radius R has a length which is between D and *d* when the members 30 and 40A–D are in an intermediate position. In accordance with this invention, the arrangement of the members 30 and 40A–D, and the identical elliptical configuration of the members assures that the contact radius R for the rotary central member 30 is identical to the contact radius R for each of the engaged reciprocatory members 40A–D throughout the operation of the drive mechanism 100. As a result of this invention, each of the elliptical members 30 and 40A–D rotates about its elliptical centerpoint, on the wrist pin 41, with a selected constant angular velocity. Of course it should be understood that in the second embodiment only members 40A—D are rotating but the contact radii of the elliptical members 30 and 40A–D will still be equal at all times. Accordingly, the reciprocatory elliptical members 40A–D will rotate with a constant angular velocity.

Because the angular velocity of all of the engaged members 30 and 40A–D is constant and substantially identical, the members 30 and 40A–D will rotate without producing any substantial relative rotational acceleration or deceleration between the engaged members 30 and 40A–D. This substantial elimination of acceleration and deceleration removes the forces from the drive mechanism that would otherwise cause sliding friction and the resulting friction losses between the engaged members 30 and 40A–D. With this invention, the engagement between the members 30 and 40A–D will be a rolling frictional engagement, and the losses experienced will be minimum rolling friction losses. In the embodiment where the central elliptical member 30 is stationary the elimination of acceleration and deceleration of the rotating members 40A–D will of course minimize friction in that embodiment as well.

The drive mechanism 100 of the first embodiment of the present invention operates to convert the rotary motion of the shaft 20, and the members 30 into reciprocatory motion of pistons attached to the members 40A–D, or operates with equal facility to rotate the shaft 20 and the member 30 in response to a fluid force applied to the transducer pistons transmitted through the elliptical members 40A–D. The operation of the drive mechanism 100, as shown in a transducer adapted as a pump or compressor is begun by rotating the central drive shaft 20 in a clockwise direction by a suitable external power source (not shown). The rotation of the shaft 20 imparts rotary motion in the same direction to the elliptical member 30. The rotation of the member 30 imparts a comparable rotation to the engaged members 40A–D. As shown by the arrows in FIGS. 1–3 the members 40A–D thereby rotate in a counter-clockwise direction about their wrist pins 41. Since the contact radius R for the member 30 and each engaged member 40A–D remains equal, as the radius varies between diameters D and d, the members 30 and 40A–D rotate with the same angular velocity. As the members 40A–D rotate in engagement with the member 30, the contact points C on the engaged members change from the initial condition shown in FIG. 1 to an intermediate position shown in FIG. 2.

This relative rotation causes the major diameter D of the member 30 to rotate toward alignment with the major diameter D of the opposed member 40A and 40C. Similarly, the minor diameter *d* of the member 30 rotates toward the minor diameter *d* of the opposed members 40B and 40D. This action causes the members 40A and 40C to reciprocate outwardly with respect to the shaft 20 until the major diameters D of the members 30 and 40A, C are in alignment, as shown in FIG. 3.

Simultaneously, the other opposed members 40B and 40D reciprocate inwardly until the minor diameters *d* of the members 30, 40B, D are in alignment. The pistons associated with the members 40A and 40C are thereby driven through an outer compression or pumping stroke, and the pistons associated with the members 40B and 40C are driven through an inward suction or intake stroke.

The length of the piston stroke in the embodiment shown in FIGS. 1–3 is equal to the difference between the major diameter D and the minor diameter *d*. Each of the members 40A–D and their associated pistons will cycle through a complete stroke for each 180° rotation of the shaft 20 and the connected member 30. Each of the pistons will therefore be driven through two complete cycles for each revolution of the shaft 20.

During the above-described operation of the transducer including the drive mechanism 100, the wrist pins 41 are guided for reciprocation by direct connection to pistons or by other suitable guide means. Throughout this operation, the links 42 space the wrist pins 41 a constant distance apart and assist in the synchronization of the relative rotation of the elliptical members 30 and 40A–C. The spring strap link 42 as shown in FIG. 1 also applies an inward pre-loading force to the pins 41 and the connected pistons and elliptical members. The gearing 50, as shown in FIG. 10 continuously mesh as the members 30 and 40A–D rotate in engagement. The gearing 50 assures the synchronized roation of the members by absorbing tangential loads which may otherwise cause slippage which would alter the relative rotational relationship of the members. The link 42 assists in this synchronization by maintaining the distances between the wrists pins 41 constant and thereby maintaining the gearing 50 in meshing engagement.

The drive mechanism of the second embodiment of the present invention operates on the same principles as the first embodiment. The mechanical difference is that the central elliptical member 30 is stationary thus causing the reciprocatory elliptical members 40A–D to revolve around the member 30 as they reciprocate. The operation of this modified drive mechanism in a transducer adapted as a pump or compressor is begun by rotating the reciprocatory elliptical members 40A–D around the central elliptical member 30. This is accomplished by positioning the pistons in which the elliptical members 40A–D are situated in a rotary cylinder block which is coupled to a drive shaft. This will be discussed in detail below. If the drive shaft rotates counter-clockwise the reciprocatory elliptical members 40A–D will also rotate counter-clockwise in rolling around the central elliptical member 30. In all other respect the action of this modified drive mechanism is similar to that described above. Since equal contact radii are maintained between the elliptical members 30 and 40A–D the members 40A–D rotate at constant angular velocity and cause the members 40A–D to reciprocate as described above. The gearing and links are preferably the same as that detailed above with the first embodiment.

Figure 4:
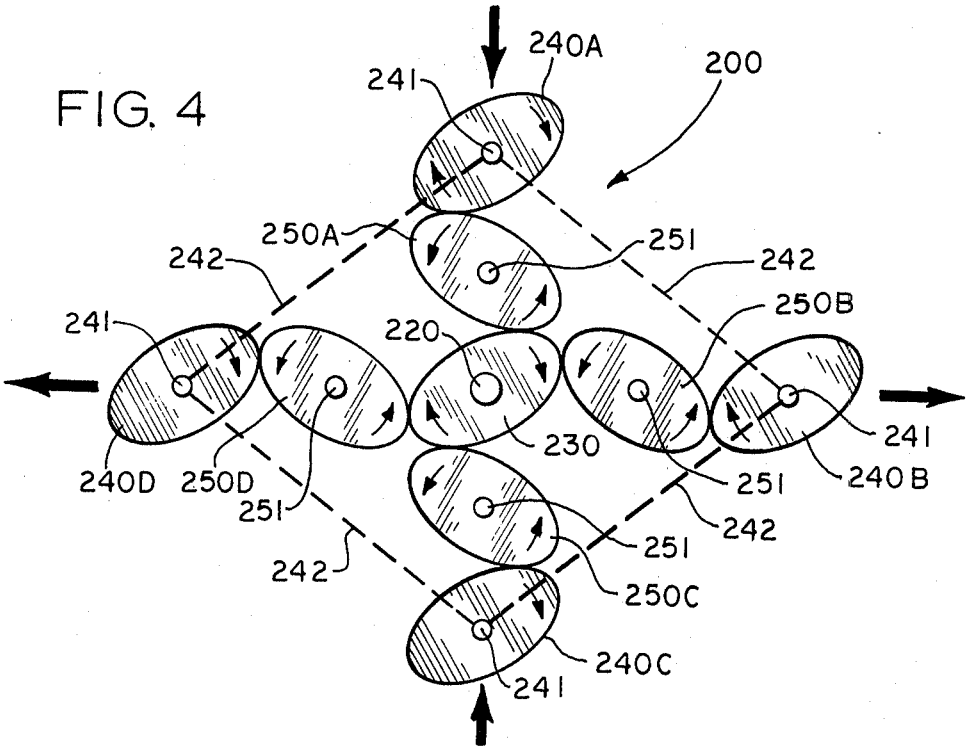
FIG. 4 is a schematic illustration of a modified form of the elliptical drive mechanism in accordance with this invention utilizing multiple elliptical members to increase the distance of the resulting stroke of the associated piston members.
Figure 5:
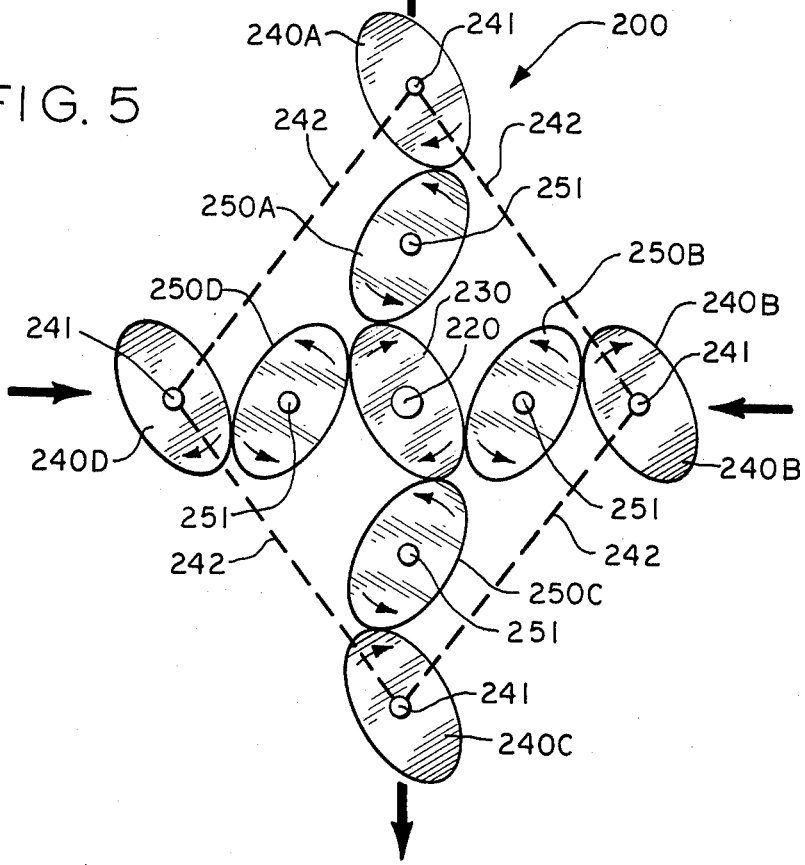
FIG. 5 is a schematic illustration of the modified drive mechanism illustrated in FIG. 4, shown in an advanced operating position.

A modified drive mechanism 200 embodying the features of the present invention is illustrated in FIGS. 4 and 5. While this embodiment may be used in conjunction with either the first or second embodiment described above, this mechanism will be described as it is applied to the embodiment having a rotating central ellipse. The basic principles of operation of the drive mechanism 200 are the same as in the above-described drive mechanism 100. A central rotary shaft 220 includes a rotatable centrally located elliptical member 230. A plurality of reciprocatory and rotatable elliptical members 240A–D are uniformly spaced around the central shaft 220. In a manner similar to the above-described members 40A–D, the elliptical members 240A–D are pivotally connected to centrally located wrist pins 241. The wrist pins 241 are guided, such as by connection to a piston, so that the pins and associated elliptical members reciprocate radially with respect to the shaft 220, and rotate simultaneously during the operation of the drive mechanism 200. Links 242, similar to the above-described links 42, connect the wrist pins 241. Moreover, each of the elliptical members 230 and 240A–D includes the synchronization gearing 50 as illustrated in FIG. 10.

The dimensional relationship and arrangement of the elliptical members 230 and 240A–D are the same as described above with respect to the elliptical members 30 and 40A–D in the drive mechanism 100. Furthermore, as seen in FIGS. 4 and 5, the operation of the elliptical members 230 and 240A–D, for converting rotary motion of the shaft 220 into reciprocation of the pistons associated with wrist pins 241, or vice versa, is the same as described above with respect to the drive mechanism 100.

The modified form of the invention illustrated in FIGS. 4 and 5 includes an additional set of elliptical members 250A–D interposed between the central member 230 and the members 240A–D. The second set of elliptical members 250A–D are mounted for rotation within the transducer drive drive mechanism 200 upon wrist pins 251. The wrist pins 251 are guided radially in the drive mechanism 200 by suitable means, such as by connection to an extended skirt portion of the associated piston or by radial guide tracks in the transducer. The members 250A–D, like the members 240A–D can thereby simultaneously reciprocate and rotate during the operation of the drive mechanism 200. In all other respects, the elliptical members 250A–D are identical in construction and configuration to the elliptical members 230 and 240A–D. Each elliptical member 250A–D also includes the gearing 50 shown in FIG. 10. The engagement of the elliptical members 250A–D with the central member 230 and the outer members 240A–D is the same as described above with respect to the members 30 and 40A–D.

The inclusion of the intermediate members 250A–D in the drive mechanism 200 increases the length of the stroke of the piston members associated with the outer members 240A–D. Since the length of the stroke of each of the pistons is equal to the difference between the major diameter D and the minor diameter *d* of the elliptical members included in the drive mechanism 200, the inclusion of the plurality of elliptical members 250A–D in series with the members 240A–D doubles the resulting piston stroke. As compared to the mechanism 100, where the stroke is D-*d*, the resulting stroke of the pistons in the mechanism 200 is doubled to 2(D-*d*). The invention thereby provides a simple method of adjusting the piston stroke to suit particular transducer applications.

Intermediate members 250A–D may also be used with the second embodiment described above. In this mechanism the intermediate members 250A–D and the outer members 240A–D revolve around the stationary central elliptical member, but in all other respects the operation and construction is the same as that described above and illustrated in FIGS. 4 and 5.

Figure 6:
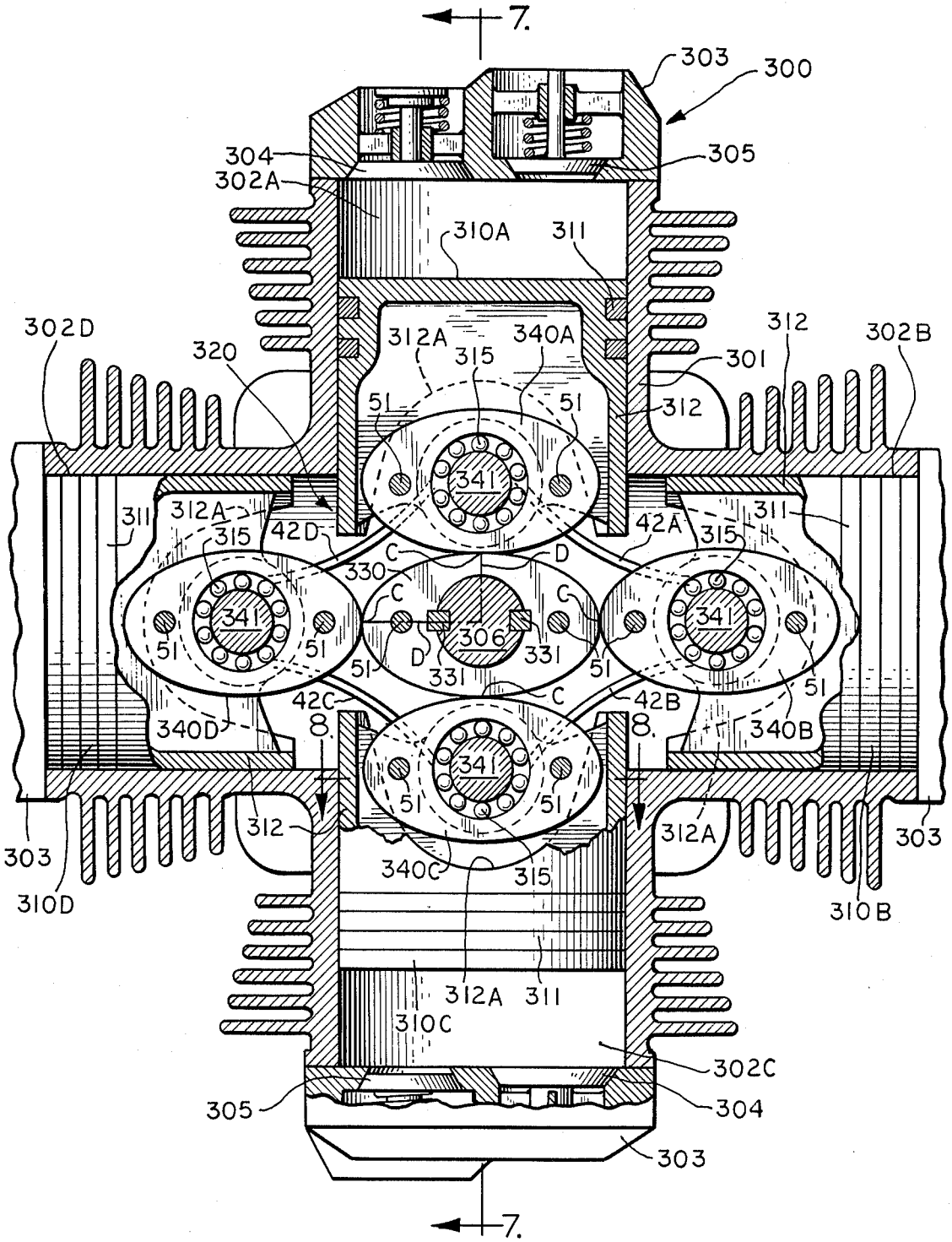
FIG. 6 is a cross-sectional elevational view of an opposed piston compressor embodying the elliptical drive mechanism of the present invention.

FIGS. 6 and 7 illustrate the elliptical cam drive mechanism in accordance with this invention embodied within an opposed piston compressor 300. The compressor 300 includes a housing 301 defining four opposed compression cylinders 302A–D. A cylinder head 303 closes the outer open end of each cylinder 302A–D. Suitable valving, such as a spring-loaded poppet intake valve 304 and poppet exhaust valve 305, are provided in each of the cylinder heads 303 to control the flow of fluid to and from the compressor cylinders 302A–D. A power input shaft 306 is centrally disposed in the compressor 300, and is supported in the walls of the housing 301 in bearings 307. The shaft 306 includes a key-way 308 or other suitable means to connect the shaft to an external power source (not shown).

As seen in FIGS. 6 and 7, a plurality of reciprocating pistons 310A–D are positioned within the piston cylinders 302A–D. Each of the pistons 310A–D includes piston rings 311, for sealing the cylinders. Each of the pistons 310A–D also includes a skirt portion 312 which extends downwardly toward the input shaft 306. The piston skirts 312 have opposed recesses 312A to provide operating space for the elliptical drive mechanism in accordance with this invention.

Each of the pistons 310A–D further includes a pair of inwardly extending support flanges 313. As seen in FIG. 7, the flanges 313 include a bore 314 for receiving a wrist pin 341. The bores 314 are arranged on the associated pistons 310A–D so that the wrist pins 341 are centered along the axial centerlines of the pistons. Furthermore, as seen in FIG. 6, the bores 314 are in the same position on each of the pistons so that the wrist pins 341 are supported in the same location on each piston with respect to the central shaft 306.

The elliptical drive mechanism incorporated within the compressor 300 is generally indicated by the reference numeral 320 in FIG. 6. The drive mechanism 320 includes a main drive cam 330 connected to the central shaft 306 by keys 331. The drive cam 330 therefore rotates in unison with the input shaft 306. Rotatable and reciprocatory driven cams 340A–D are uniformly spaced around the main drive cam 330. As seen in FIG. 6, the driven cams 340A–D are pivotally supported for rotation on the wrist pins 341 provided on the pistons 310A–D by suitable needle bearings 315. The wrist pin connection also causes the pistons 310A–D and the cams 340A–D to reciprocate in unison.

The drive mechanism 320 also includes four spaced pairs of strap links 42A–D joined between adjacent wrist pins 341. Suitable bearings 43 pivotally support each strap link on the wrist pins 341 so that the links may freely rotate on the pins. Each of the strap links 42A–D is made from preformed spring steel or the like, so that the links apply a slight inward preloading force to each of the connected wrist pins 341 and pistons 310A–D.

As illustrated in FIGS. 7, 8 and 10, each of the cams 330 and 340A–D includes elliptical roller gearing 50. As shown in FIGS. 7 and 8, the gearing 50 is preferably laminated between separable halves of each of the cams 330 and 340A–D and is secured in place by connecting pins 51. As explained above, the pitch line P for the gearing 50 in the illustrated embodiment coincides with the elliptical contour of each of the associated cams 330 and 340A–D.

In accordance with this invention, the cams 330 and 340A–D of the drive mechanism 320 are true ellipses having the same major and minor diameters and therefore the same external elliptical cam contours. Furthermore, as shown in FIGS. 6 and 7, the cams 340A–D are arranged in camming engagement with the main cam 330, and are synchronized so that the major and minor diameters of the cams 340A–D align with the major and minor diameters of the main cam 330 during the operation of the drive mechanism 320 as explained above with respect to the drive mechanism 100 shown in FIGS. 1–3. The strap links 42A–D maintain the wrist pins 341 equally spaced throughout the operation of the drive mechanism 320, and assist in synchronizing the relative rotation of the cams 330 and 340A–D. In addition, the meshing of the gearing 50 provided on each of the engaged cams 330 and 340A–D synchronizes the cam operation by preventing slippage between the engaged cam surfaces during the operation of the drive mechanism 320.

To operate the compressor 300, the input shaft 306 is rotated at a selected speed by an external power source (not shown). In addition, the intake and exhaust valve 304 and 305 are operated by suitable valve control means, and are connected to standard intake and exhaust manifolds (not shown). As explained with reference to FIGS. 1–3, the rotation of the input shaft 306 rotates the main drive cam 330 at a constant speed. The rotation of the drive cam 330 in turn causes the periphery of the cam 330 to frictionally engage the peripheries of the cams 340A–D.

The motion of the cam 330 thereby imparts a rotary motion to each of the engaged cams 340–D. Throughout the rotation of the engaged cams 330 and 340A–D, the contact points C between the cams **340*a–d* and 330** will vary from the minimum inward location, defined by the engagement of the minor elliptical diameters *d*, to a maximum outward location defined by the engagement of the major elliptical diameters D. As the main cam 330 rotates, the strap links 42A–D and the gearing 40 assures that the cams 340A–D maintain the proper position in rolling engagement with the periphery of the main cam 330. The continuous rotation of the cam 330 therefore urges the two opposed pistons 310A and 310C outwardly through a compression stroke equal to D-*d*, to thereby compress the fluid contained within the cylinders 302A and 302C. Simultaneously the rotation of the main cam 330 permits the strap links 42A–D to draw the other opposed pistons 310B and 310D inwardly through the same stroke. The pistons 310B and 310D are thereby drawn inwardly through a suction stroke, and draw fluid into the chambers 302B and 302D through the intake valves 304.

Accordingly, one pair of opposed pistons in the compressor 300 is driven through a compression stroke at the same time that the other pair of opposed pistons is driven through a suction stroke. This cycle of operation is repeated twice for each complete revolution of the main cam 330.

FIGS. 11 and 12 illustrate another embodiment of the present invention adapted for use in a four-cycle internal combustion engine 400. The engine 400 includes a housing 401 which defines four uniformly spaced and radially opposed piston chambers 402A–D. Each of the cylinders 402A–D is closed by a cylinder head 403. Suitable intake valves 404, exhaust valves 405, and a spark plug 406 are included in each cylinder head 403. The housing 401 also defines intake and exhaust manifolds 407 and 408 respectively. The intake manifolds 407 are connected to the intake valves 404 of two adjacent cylinders (e.g. 402A and 402D). Similarly, the exhaust manifolds 408 are connected in fluid communication with the exhaust valves 405 of two adjacent cylinders (e.g. 402A and 402B).

The housing 401 of the internal combustion engine 400 also supports a central, rotatable output shaft 409 on suitable bearings (not shown). The shaft 409 extends beyond the housing 401 and is adapted for connection to a load to be driven by the engine 400.

A plurality of reciprocating pistons 410A–D are positioned within the cylinders 402A–D. Each piston is sealed in the cylinder by piston rings, and includes an extended skirt portion 142. Opposed recesses 412A in each skirt 412 provide operating space for the elliptical drive mechanism of this invention. As described above with respect to the compressor 300, each piston 410A–D in the engine 400 supports a centrally located wrist pin 441.

The elliptical drive mechanism for the engine 400 is generally designated in FIG. 11 by the reference numeral 420. The drive mechanism 420 includes a main output cam 430 which is keyed for rotation with the output shaft 409. A plurality of rotatable and reciprocatory cams 440A–D are arranged uniformly in the engine 400 in camming engagement with the output cam 430. The cams 440A–D are pivotally supported on the wrist pins 441 so that one cam is associated with each piston 410A–D. As described above, spaced pairs of strap links 42A–D join the adjacent wrist pins 441, and preferably apply a slight inward pre-loading force to the pistons 410A–D. Each of the cams 430 and 440A–D further includes the elliptical rolling gearing 50, such as illustrated in FIGS. 8 and 10.

The cams 430 and 440A–D in the drive mechanism 420 are true ellipses having the same major and minor diameters. Also, the cams are arranged in the engine 400 so that relative rotation of the cams aligns the major and minor cam diameters, as described above. The cams 430 and 440A–D thereby rotate in camming engagement with the relative rotation of the cams guided and synchronized by the links 42 and the gearing 50.

The operation of the engine 400 is begun in the usual manner by cranking a flywheel or the like, to introduce an appropriate air-fuel mixture into two of the opposed cylinders, such as cylinders 402A and 402C. Then, a conventional ignition and timing system (not shown) fires the spark plugs 406 to ignite the compressed air fuel mixture in the charged cylinders 402A and 402C. The explosive charges force the associated pistons 410A and 410C inwardly through a power stroke. This inward reciprocation of the pistons in transmitted through the wrist pins 441 to the connected reciprocatory cams 440A and 440C. The inward reciprocation of the cams 440A and 440C causes the cams to frictionally roll along the cam profile of the engaged driven cam 430, and thereby imparts rotary motion to the cam 430 and the output shaft 409.

As seen from FIG. 11, the two cams 440A and 440C apply balanced drive forces to the driven cam 430 from opposite directions, as the pistons 410A and 410 move inwardly through a stroke equal to the difference between the major and minor diameters of the cams 430 and 440A–D.

The above-described rotation of the driven cam 430 simultaneously causes the cam 430 to frictionally engage and rotate the other opposed cams 440B and 440D. The drive mechanism 420 thereby drives the cams 440B and 440D, and the connected pistons 410B and 410D through an outward compression stroke as the other pistons 410A and 410C are driven through their power strokes. The strap links 42A–D and the gearing 50 maintain the cams 430 and 440A–D in engagement and synchronization throughout the operation of the engine 400.

The cycle of operation is continued by firing the spark plugs 406 associated with the cylinders 402B and 402D, to drive the pistons 410B and 410D inwardly through their power strokes. As the pistons 410B and 410D are driven downwardly, the drive mechanism 420 drives the other pair of opposed pistons 410A and 410C outwardly through their exhaust strokes. The valves 405 open to exhaust the spent gases from the cylinders 402A and 402C into the connected exhaust manifolds 408.

This above-described sequential operation of the engine 400 continues as each piston 410A–D travels through a complete cycle of intake, compression, power and exhaust strokes each revolution of the output shaft 409. The drive mechanism 420 thereby converts the reciprocatory motion of the pistons 410A–D into a rotary power output of the shaft 409.

Figure 14:
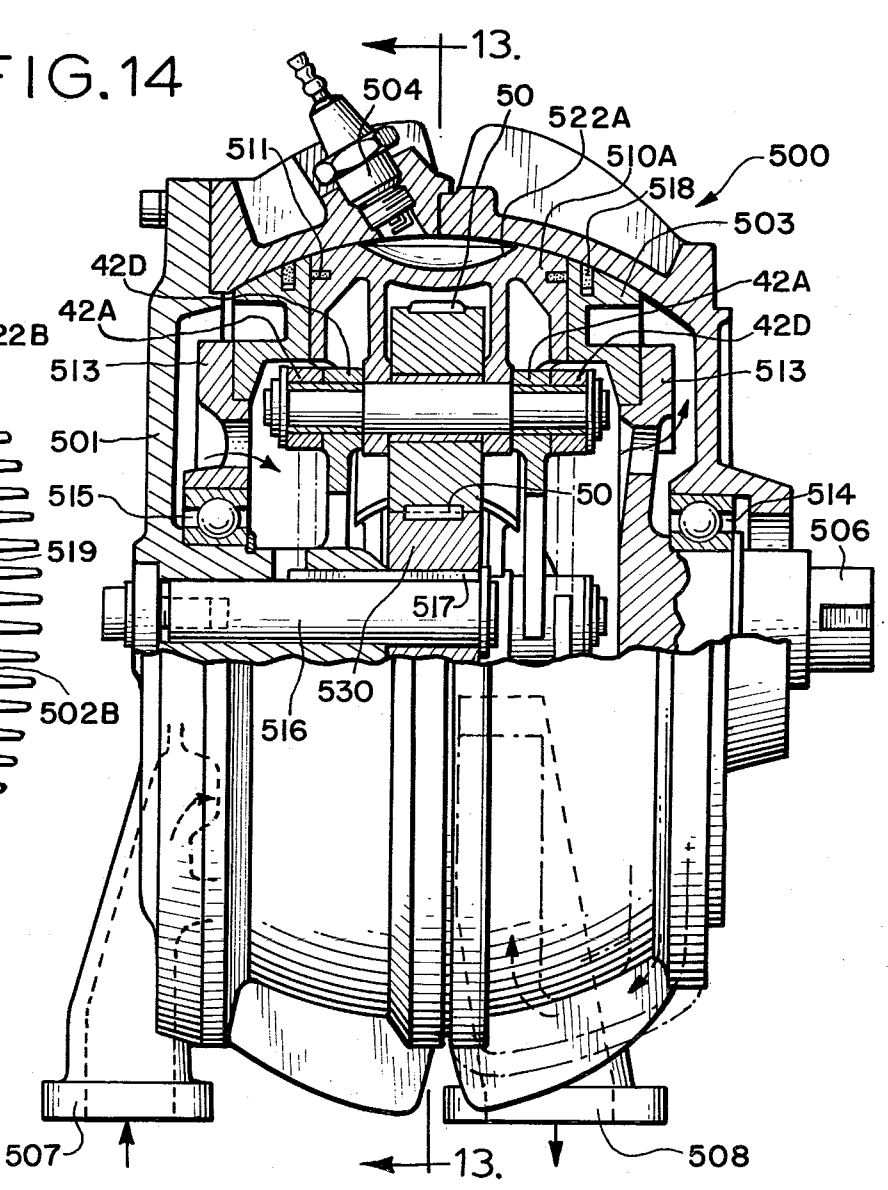
FIG. 14 is a partial cross-sectional elevation view of the engine taken along the lines 14—14 in FIG. 13.
Figure 13:
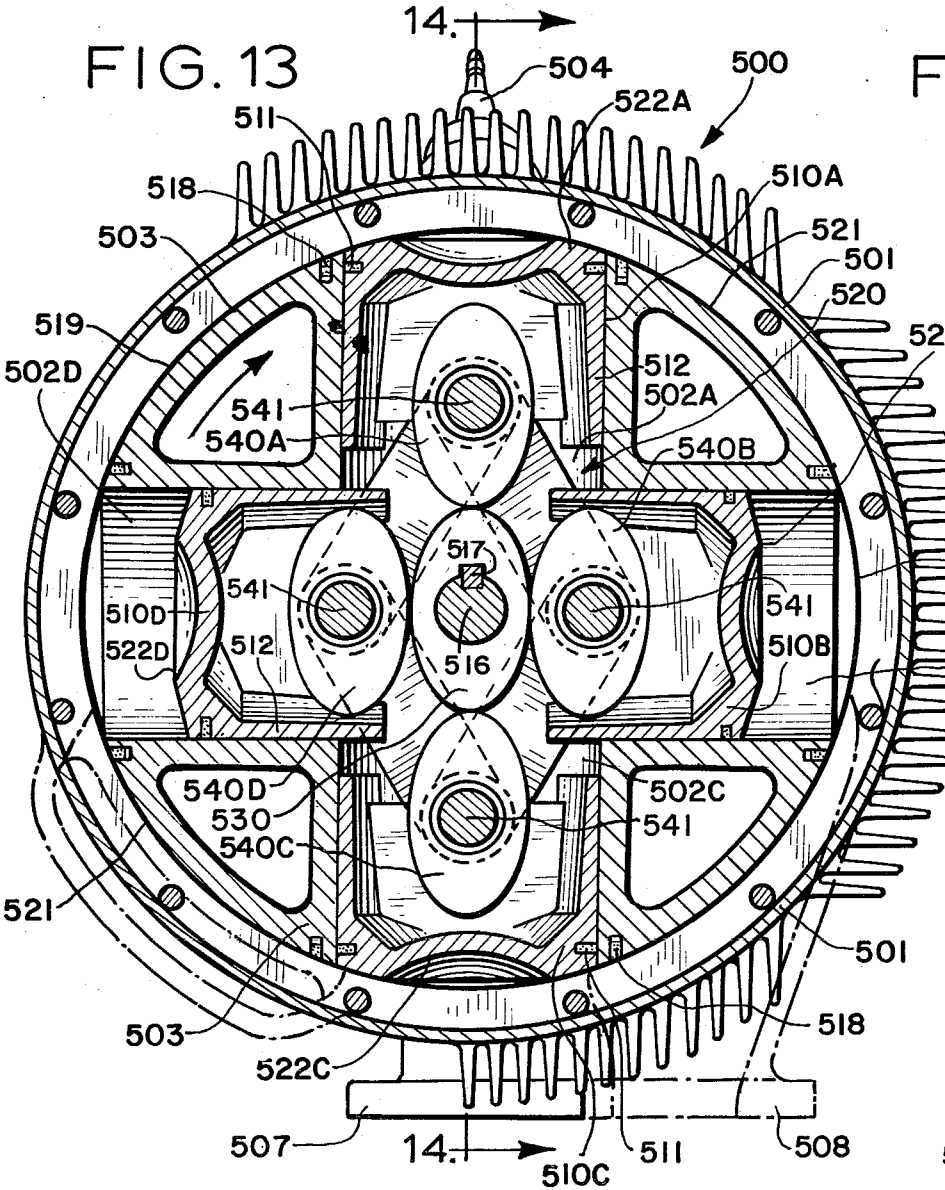
FIG. 13 is a cross-sectional elevation view of an opposed piston rotary internal combustion engine taken along lines 13—13 in FIG. 14 embodying the elliptical drive mechanism of the present invention.

FIGS. 13 and 14 illustrate another embodiment of the present invention adapted for use in a four-cycle rotary internal combustion engine. The engine 500 includes a stationary housing 501 with intake and exhaust ports 507 and 508. A spark plug, mounted in the housing, is shown at 504. The cylinder block or rotor 503 with side plates 513 is rotatably supported within the housing by bearings 514 and 515. While ball bearings are depicted in the drawings, the bearings 514 and 515 may be of any conventional type. A power shaft 506 is connected to the rotor 503 for rotation therewith. The cylinder block or rotor 503 defines four uniformly spaced and radially opposed piston chambers 502A–D. Reciprocatory pistons 510A–D with combustion cavities in the heads 522 are positioned within the cylinders 502–D. Each piston is sealed by piston rings 511, and includes an extended skirt portion 512. Cylinders 502A–D are each provided with a seal ring 518 for minimizing leakage between cylinders. In order to accomplish this with circular seal rings, the inner housing wall 519, the outer cylinder block surface 521 and the piston heads 522A–D are spherical. As described above with respect to the compressor 300, each piston 510A–D in the engine 500 supports a centrally located wrist pin 541.

The elliptical drive mechanism for the rotary engine 500 is generally designated by the numeral 520. The drive mechanism 520 includes a stationary elliptical cam 530 which is secured to a central shaft 516 by a key 517. This central shaft 516 is fixed to the stationary housing 501. A plurality of rotatable and reciprocatory cams 540A–D are pivotally supported on the wrist pins 541 so that one cam is associated with each piston 510A–D. As in the compressor 300 detailed above, spaced pairs of strap links 42A–D join the adjacent wrist pins 541, and preferably apply a slight inward preloading force to the pistons 510A–D. Each of the cams 530 and 540A–D further includes the elliptical rolling gearing 50, as illustrated in FIGS. 8 and 10.

As with the engine 400 described above, the cams 530 and 540A–D are true ellipses having the same major and minor diameters, and are arranged so that rotation of the cams aligns the major and minor diameters, as previously described. The cams 540A–D thereby rotate in camming engagement with stationary cam 530 and are guided and synchronized by the links 42 and the gearing 50.

The operation of the rotary engine 500 follows the conventional four-stroke cycle, i.e., intake, compression, power, exhaust. FIG. 13 shows piston 510C just beginning intake; piston 510D just ready to being compression; piston 510A as ignition is beginning; and piston 510B just beginning exhaust.

A fuel-air mixture is drawn from the carburetor into the engine 500 at 507, cooling and lubricating all internal parts as indicated by small arrows. This mixture flows through intake port 507 into the intake cylinder, here 510C during approximately 90° shaft-rotation from 6 O'clock to 9 O'clock. The mixture is then compressed during the following 90° shaft-rotation from 9 O'clock to 12 O'clock, at which point the spark plug 504 ignites the compressed fuel-air mixture. Ignition is followed by the power stroke from approximately 12 O'clock to 3 O'clock where the exhaust port 508 is uncovered. The piston forces out exhaust gases from b 3 O'clock to 6 O'clock at which point the cylinder wall covers the exhaust port 508 and exposes the intake port 507.

The drive mechanism 520 of the rotary engine 500 acts to transform the reciprocatory action of the pistons 510A–D into rotation of the reciprocatory cams 540A–D, the cylinder-head or rotor 503 and the power shaft 506. As the spark plug 504 ignites the compressed air-fuel mixture, the piston 510 is driven downward through the power stroke. This reciprocation is transmitted through the wrist pins 541 to the connected reciprocatory cam 540. This causes the cam to roll along the cam profile of the engaged central stationary cam 530 thereby causing the rotor 503 and the power shaft 506 connected thereto to rotate in a clockwise direction. As with the engine 400, the strap links 42A–D and the gearing 50 maintain the cams 540A–D in engagement and synchronization throughout the operation of the rotary engine 500.

The exact positions of the ports and the ignition timing differ slightly depending on the type of fuel used and the expected operating conditions but this is well know in the art of internal combustion engines. Similarly lubrication and cooling may be modified as required. Any conventional method of emission control can be applied to the present invention.

Figure 16:
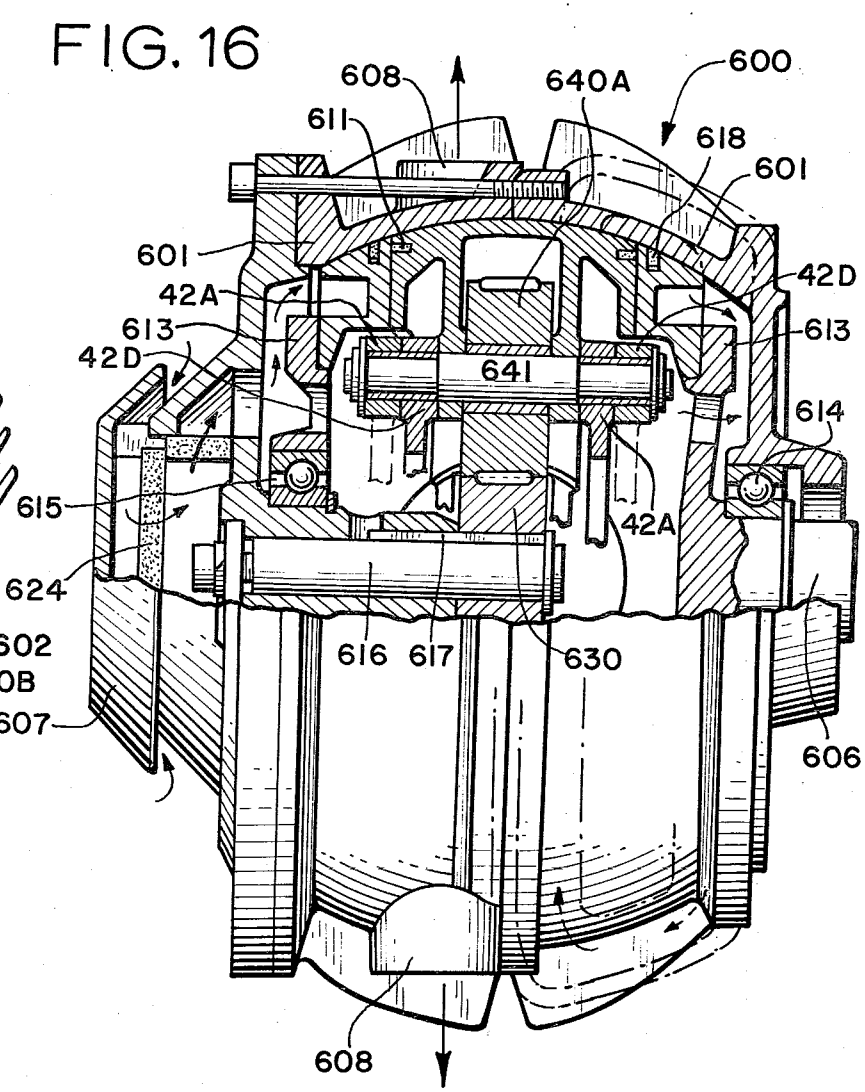
FIG. 16 is a partial cross section elevation view of the compressor taken along the lines 16—16 in FIG. 15.
Figure 15:
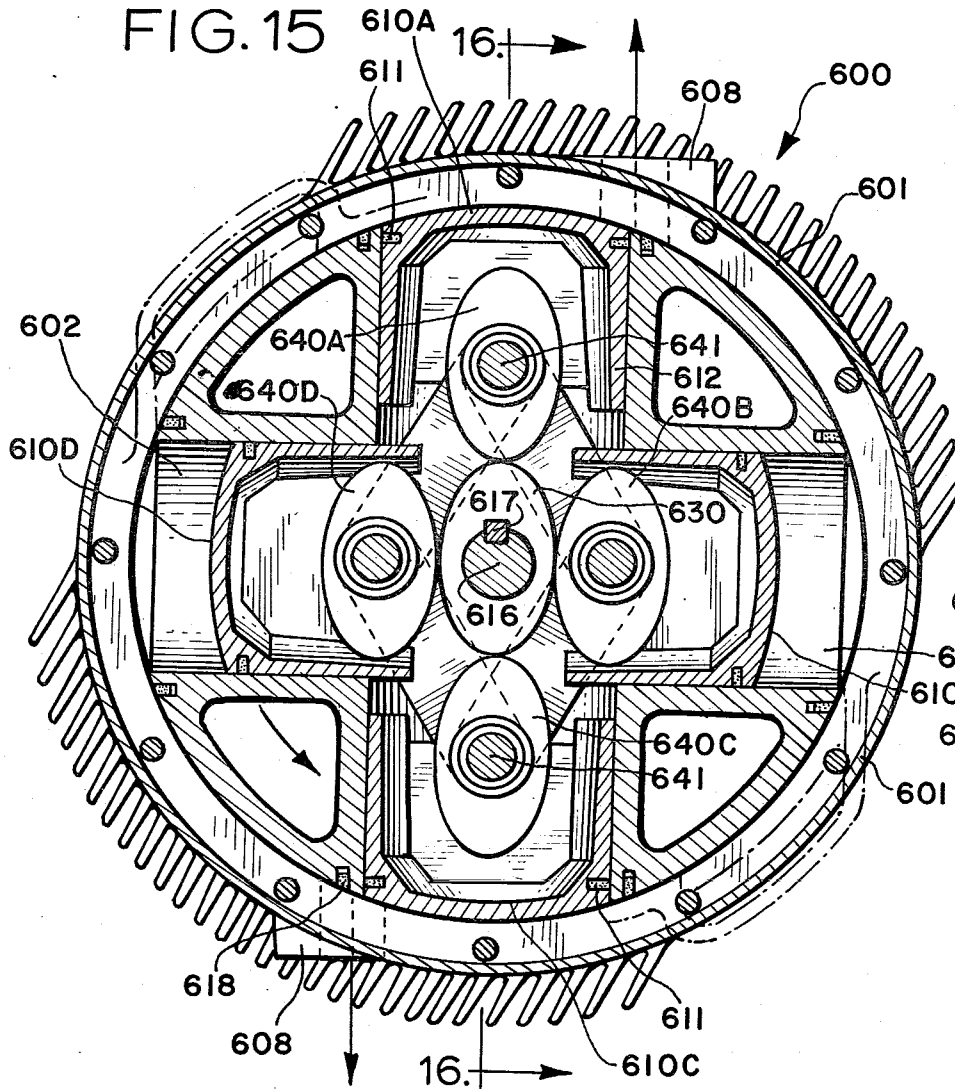
FIG. 15 is a cross-sectional elevation view of an opposed piston rotary compressor embodying the elliptical drive mechanism of the present invention.

FIGS. 15 and 16 illustrate the elliptical cam drive mechanism in accordance with this invention embodied within a rotary compressor 600. With a few exceptions the rotary compressor design is very similar to that of the rotary engine 500. The stationary housing 601 surrounds the cylinder block or rotor 603 with side plates 613 which is rotatably supported by bearings 614 and 615. A power shaft 606 is connected to the rotor 603 for rotation therewith. The cylinder block or rotor 603 defines four radial cylinders 602A–D. Reciprocatory pistons 610A–D with piston rings 611 and skirts 612 are positioned therein. Cylinder seal rings 618 are positioned therein. Cylinder seal rings 618 are provided as in the rotary engine 500. Each piston has a spherical head 622A–D and supports a central wrist pin 641.

The elliptical drive mechanism generally designated by 620 includes a stationary elliptical cam 630 which is secured to a central shaft 616 by a key 617. This shaft 616 is fixed to the stationary housing 601. A plurality of rotatable and reciprocatory cams 640A–D are provided and positioned with strap links 42A–D and gearing 50 as in the rotary engine 500.

The primary differences between the rotary compressor 600 and the rotary engine 500 are that the piston heads 622A–D do not have cavities for combustion nor is there a spark plug in the compressor. Of course, the porting is also very different in the compressor. Each piston 610A–D has two intake and compression strokes per revolution so two diametrically opposed intake channels 607 and exhaust or delivery ports 608 are provided. The gas intake 623 is opposite the power shaft 606 in the illustrated compressor and is provided with filters 624. Cooling for internal parts is by intake air in the illustrated apparatus as in the rotary engine 500. Lubrication, not shown, is provided by conventional means.

The operation of the compressor is relatively simple. The power shaft 606 drives the cylinder head or rotor 603 in the counter-clockwise direction in the illustrated compressor. The pistons 610A–D, wrist pins 641 and reciprocatory elliptical cams 640A–D carried therein are forced to rotate around the central stationary cam 630. The rolling engagement and elliptical configuration of the cams 630 and 640A–D causes the pistons to reciprocate as in the rotary engine 500. Cylinder 602A is presented to the intake port 607 from the 12 O'clock position to approximately 9 O'clock. Compression begins at 9 O'clock and continues until the cylinder opens to delivery port 608. This cycle is repeated from 6 O'clock to 12 O'clock and is identical to that of the other cylinders 602B–D.

It is important to note that this invention may also be used as a rotary air motor or steam engine with little modification from the compressor embodiment. In this embodiment the air or steam forces the pistons to reciprocate and the cylinder head to rotate thus driving the power shaft as in the rotary engine.

Although the invention has been described with a certain degree of particularity, it should be understood that the present disclosure has been made only by way of example. Consequently, numerous changes in the details of construction and the combination and arrangement of components as well as the possible modes of utilization will be apparent to those familiar with the art, and may be resorted to without departing from the spirit and scope of the invention as claimed

What is claimed is:

1. A fluid transducer for imparting energy to or receiving energy from a fluid comprising:

a housing;

a cylinder block rotatably mounted within said housing, said block including a cylinder with a reciprocatory piston mounted therein;

a first elliptical member stationary with respect to said housing and having selected major and minor diameters;

a second elliptical member having substantially the same major and minor diameters as the first elliptical member and rotatably mounted in association with said piston to rotate and reciprocate as said piston reciprocates;

means to retain said first and second elliptical members in engagement as said piston reciprocates; and said first and second elliptical members further being arranged in said transducer so that said second member rotates in said engagement with said first elliptical member with constant angular velocity as said piston reciprocates whereby said transducer transmits motion between said piston and said rotatable cylinder block.

2. A fluid transducer in accordance with claim 1 wherein said transducer includes a rotatable and reciprocatory third elliptical member having the same major and minor diameters as said first and second elliptical members and intermediately positioned in engagement with said first and second elliptical members; said third elliptical member rotating with said second elliptical member to transmit motion between said first and second elliptical members and to increase the resulting stroke of said piston.

3. A fluid transducer for imparting energy to or receiving energy from a fluid comprising:

a housing;

a cylinder block rotatably mounted within said housing, said block including a plurality of cylinders;

a corresponding plurality of reciprocatory pistons mounted with the cylinders;

a first elliptical member stationary with respect to said housing and having selected major and minor diameters;

a plurality of second elliptical members having substantially the same major and minor diameters as the first elliptical member, each of said second elliptical members being mounted in said transducer to rotate about its elliptical center and to rotate and reciprocate in association with the reciprocation of one of said pistons;

said second elliptical members being arranged in engagement with said first elliptical member so that said second elliptical members rotate with constant angular velocity as said second elliptical members and said pistons reciprocate with respect to said first elliptical member; and means to retain said second elliptical members in said engagement with said first elliptical member whereby the transducer transmits motion between said pistons and said rotatable cylinder block.

4. A fluid transducer in accordance with claim 3 wherein said means to retain said second elliptical members in engagement with said first elliptical member comprises pivotal linking means joining the elliptical centers of said second elliptical members.

5. A fluid transducer in accordance with claim 3 wherein each of said second elliptical members is rotatably mounted on one of said pistons for reciprocation therewith.

6. The fluid transducer in accordance with claim 3 wherein said second elliptical members are positioned so that the major and minor diameters of second elliptical members align with the major and minor diameters of said first elliptical member during the operation of said transducer, so that said elliptical members transmit motion between said piston members and said rotatable cylinder block without substantial rotational acceleration or deceleration.

7. The fluid transducer in accordance with claim 3 including means to maintain a selected relative position of said second elliptical members with respect to said first elliptical member comprising gearing means provided on the engageable peripheries of each of said first and second elliptical members which mesh to maintain the relative position of said elliptical members as said pistons reciprocate with respect to said first elliptical member.

8. The fluid transducer in accordance with claim 7 wherein said pistons reciprocate in response to the force of a fluid pressure aplied thereto so that said elliptical members convert the reciprocation of said pistons into rotary motion of said rotatable cylinder block.

9. The fluid transducer in accordance with claim 8 wherein said housing includes intake and exhaust ports so that as the cylinder block rotates said intake port is presented to at least one of said pistons during a piston intake stroke, and said exhaust port is presented to at least one of said pistons during a piston exhaust stroke.

10. The fluid transducer in accordance with claim 7 wherein said cylinder block rotates in response to an external rotary force applied thereto and said elliptical members convert said rotary force into reciprocatory motion of said pistons to impart energy to a fluid through said pistons.

11. The fluid transducer in accordance with claim 10 further comprising rotary shaft means coupled to said cylinder block for applying said rotary force.

12. In a rotary fluid transducer having a stationary housing, a rotatable rotor mounted within said housing, and shaft means coupled for rotation with said rotor, the improvement comprising:

a plurality of radial cylinders in said rotor;

a corresponding plurality of reciprocatory pistons mounted in said cylinders; p1 a stationary first elliptical member having selected major and minor diameters positioned within said rotor;

a plurality of second elliptical members having substantially the same major and minor diameters as the first elliptical member, each of said second elliptical members being mounted in said transducer to rotate about its elliptical center and to rotate and reciprocate in response to the reciprocation of one of said pistons;

said second elliptical members being arranged in engagement with said first elliptical member so that the major and minor diameter of said second elliptical members align with the major and minor diameters of said first elliptical member during the operation of said transducer whereby said second elliptical member roll on said first elliptical member without substantial rotational acceleration or deceleration; and means to retain said second elliptical members in said engagement position with said first elliptical member whereby said transducer transmits motion between said pistons and said rotor and said rotary shaft means coupled to said rotor.

13. The rotary fluid transducer of claim 12 wherein said means to retain said second elliptical member in engagement with said first elliptical member comprises pivotal linking means joining the elliptical centers of said second elliptical members.

* * * * *